US005644995A

United States Patent [19]

Gurwell et al.

[11] Patent Number: 5,644,995

[45] Date of Patent: Jul. 8, 1997

[54] RAPIDLY ASSEMBLED AND DISASSEMBLED PORTABLE TABLE, WORK BENCH, OR THE LIKE

[76] Inventors: Hugh David Gurwell; Nancy C. Gurwell, both of 9607 Walmer, Overland Park, Kans. 66212

[21] Appl. No.: 541,115

[22] Filed: Oct. 11, 1995

[51] Int. Cl.[6] ..... A47B 83/02

[52] U.S. Cl. ..... 108/188; 108/157; 108/153; 297/158.5

[58] Field of Search ..... 108/153, 157, 108/165, 180, 187, 188; 297/158.3, 158.5, 400.13

[56] References Cited

U.S. PATENT DOCUMENTS

| | | | |
|---|---|---|---|
| 2,000,915 | 5/1935 | Blake | 311/79 |
| 2,347,821 | 5/1944 | Goldner | 155/196 |
| 2,615,771 | 10/1952 | Curtis | 311/35 |
| 2,911,265 | 11/1959 | Hannah | 108/157 X |
| 3,031,244 | 4/1962 | Stopek | 108/153 |
| 3,295,475 | 1/1967 | McClellan | 108/153 |
| 3,300,245 | 1/1967 | Rumble | 108/153 X |
| 3,338,169 | 8/1967 | Xavier | 108/111 |
| 3,475,053 | 10/1969 | Parker et al. | 297/157 |
| 4,076,305 | 2/1978 | Sullivan | 297/158.5 |
| 4,182,432 | 1/1980 | Cossitt | 297/440.13 X |
| 4,191,113 | 3/1980 | Hogberg | 108/157 |
| 4,433,753 | 2/1984 | Watson | 297/440.13 X |
| 4,630,551 | 12/1986 | Sheffer | 108/159 |
| 4,632,040 | 12/1986 | Sheffer | 108/157 |
| 4,740,032 | 4/1988 | Olsen et al. | 297/157 |
| 4,834,450 | 5/1989 | Stickler | 297/157 |
| 5,367,964 | 11/1994 | Hockensmith | 108/180 |

FOREIGN PATENT DOCUMENTS

| | | | |
|---|---|---|---|
| 826099 | 10/1969 | United Kingdom | 108/180 |

*Primary Examiner*—Peter M. Cuomo
*Assistant Examiner*—Hanh V. Tran
*Attorney, Agent, or Firm*—Kenneth W. Iles

[57] ABSTRACT

A portable table consists of four flat planar pieces that can be assembled and disassembled without fasteners, but which may include optional fasteners. The portable table consists of a pair of pedestals, each having a vertical slot from a top edge to a certain depth; a central brace member lying in a plane perpendicular to the width of the pedestals and having angled slots at about 80 degrees from the horizontal that mate with the slots in the pedestals so that the two pedestals are slightly inward leaning from their bottoms to their tops. The top edges of the pedestals and the central brace member lie in a single plane. A table top includes channel members in a bottom surface that mirror the top edges of the pedestals and the central brace member and mate therewith to provide a simple and sturdy portable table that is easily stored. Two alternative fastening systems for securing the table top to the supporting structure are disclosed, including a locking toggle clip, and a system of locking plates that are received by aligned protruding tongues fastened to the top edges of the pedestals.

1 Claim, 5 Drawing Sheets

RAPIDLY ASSEMBLED AND DISASSEMBLED PORTABLE TABLE, WORK BENCH, OR THE LIKE

BACKGROUND OF THE INVENTION

1. Field of the Invention.

The present invention is related to an apparatus that provides a table, work bench, or the like having planar horizontal working surface. More particularly, the present invention is directed to load bearing structure, such as a table, having a pair of end panels connected to a central vertically oriented brace, which together support a load bearing work surface, which requires no fasteners, but may include them.

2. Description of Related Art Including Information Disclosed Under 37 C.F.R. Sections 1.97–1.99.

Temporary work surfaces are frequently necessary or convenient in a variety of situations. When camping or picnicking, for example, tables may not be available. When working at a construction site, it is typically necessary for certain workers, such as finish carpenters, to provide their own work benches. Most existing benches or tables are not readily portable because they have large, irregular, and awkward shapes and cannot be easily loaded into most vehicles. Other types of tables or benches, such as card tables and other folding tables, may be portable, but lack the strength that many applications require.

Efforts have been made to provide a table or bench with a horizontal work surface that can be readily assembled and disassembled, but these typically have significant disadvantages. In U.S. Pat. No. 4,834,450 issued to Stickler, there is disclosed a picnic table with attached seating benches that is assembled with tabs that project into matching slots in other pieces. This table includes many parts and assembly would require a substantial amount of time. Further, the benches prevent any substantial use of the table top for any work that may require standing and the table would have at best limited stability without the benches. Another similar picnic table is disclosed in U.S. Pat. No. 4,740,032 issued to Olsen et al. Still another such table is disclosed in U.S. Pat. No. 3,475,053, issued Parker et al., which requires the use of fasteners, illustrated as nuts and bolts, which severely reduce the advantages associated with a portable table by increasing the time required for assembly and disassembly.

An executive desk similarly assembled is disclosed in U.S. Pat. No. 4,632,040, issued to Sheffer. Sheffer '040 does not include any benches, but does include a pair of vertical end panels with channels for receiving three horizontal support beams, upon which a table top sit. As it is made from corrugated fiberboard, it appears not to have the strength that many applications would require, and the perpendicular angles utilized in the assembly do not provide the good lateral stability required of work surfaces that will be used for heavy outdoor work. The use of slots that receive aligned tabs on other parts to provide an assembly have been employed in other furniture items, including tables (U.S. Pat. No. 2,615,771, issued to Curtis, and U.S. Pat. No. 2,000,915, issued to Blake); chairs (U.S. Pat. No. 2,347,821, issued to Goldner); and stools (U.S. Pat. No. 3,338,189, issued to Xavier). These and other similar devices appear either to be too complex for the casual user or not strong enough for hard use, or both.

Therefore, a need exists for a portable table that has a minimum of parts, that requires no fasteners, but may utilize reusable fasteners to insure that the table top remains attached to the portable table, even when it is lifted by the top, and that, consequently, can be readily assembled and disassembled and shipped or stored as a flat package, that can withstand rugged use, and that provides substantial lateral stability and compression strength.

SUMMARY OF THE INVENTION

Accordingly, it is a primary object of the present invention to provide a portable table having few pieces and that requires no fasteners, that can easily be assembled, stored or shipped as a flat package.

It is another object of the present invention to provide a portable table that may utilize reusable fasteners that insure that the table top remains attached to the portable table, even when it is lifted by the top, It is another object of the present invention to provide a portable table that can withstand rugged use.

It is another object of the present invention to provide a portable table that provides substantial lateral stability and compression strength.

These and other objects of the present invention are achieved by providing a portable table that consists of four interlocking flat planar pieces that can be held together by frictional engagement of the pieces without fasteners, or with permanently installed recessed and reusable fasteners. The pieces consist of a top, two identical end pedestals and a central brace member. Each pedestal includes a vertically oriented slot cut into it along a longitudinal centerline, which matches and mates with a similar slot in a wide end portion of the central brace member, which is cut at an angle to the vertical such that the legs are angled outward and the top edges of the pedestals and central brace member lie in a single plane, an inherently more stable design than legs perpendicular to a table top provide. The top has three channels that align with the top edges of the other three members, so that the channel in the top seats firmly onto the edges, securely locking the four pieces into a table of substantial strength. Each pedestal includes a cut-out U-shaped portion that leaves a pair of legs at the lower end of each pedestal, sacrificing little strength compared to a solid pedestal and reducing the weight of each pedestal, and thereby reducing the material requirements and increasing the maneuverability of the pedestals, while providing substantial strength.

In an alternative embodiment, metal tongues fixed to the top outer edges of the tops of the end pedestals engage short straps or plates fastened to the lower surface of the top, bridging the short channel members in the top, and engaging and locking the metal straps or plates on the end pedestals. A dished out intermediate portion of the top edges of the pedestals combined with a wider central longitudinal channel in the lower surface of the top allows the top to be set down at an angle and slid back into the locking position. Offsetting the central longitudinal channel allows the resulting structure to be used as a desk by providing sufficient depth between a front edge of the table or desk embodiment and the central brace member to accommodate a user's legs while sitting.

The portable table may be made from plywood, injection molded plastic, or any other convenient material having the requisite strength, rigidity, and durability. The structure disclosed herein derives its strength from the truss-like effect of providing a pair of end pedestals that are inclined toward one another at the top, i.e., and are farther apart at their lower ends.

Other objects and advantages of the present invention will become apparent from the following description taken in connection with the accompanying drawings, wherein is set forth by way of illustration and example, the preferred embodiment of the present invention and the best mode currently known to the inventors for carrying out their invention.

DETAILED DESCRIPTION OF THE PREFERRED EMBODIMENTS

As required by the Patent Statutes and the case law, the preferred embodiment of the present invention and the best mode currently known to the inventors for carrying out their invention are disclosed in detail herein. The embodiments disclosed herein, however, are merely illustrative of the invention, which may be embodied in various forms. Therefore, specific structural and functional details disclosed herein are not to be interpreted as limiting, but merely to provide the proper basis for the claims and as a representative basis for teaching one skilled in the art to which the invention pertains to make and use the apparatus disclosed herein as embodied in any appropriately specific and detailed structure.

Figure 1:
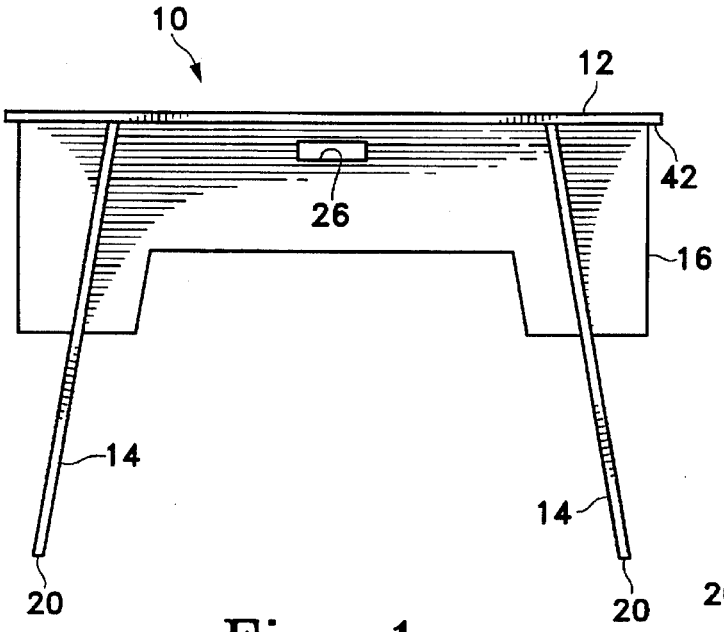
FIG. 1 is a front or rear elevation of a portable table according to the present invention.
Figure 2:
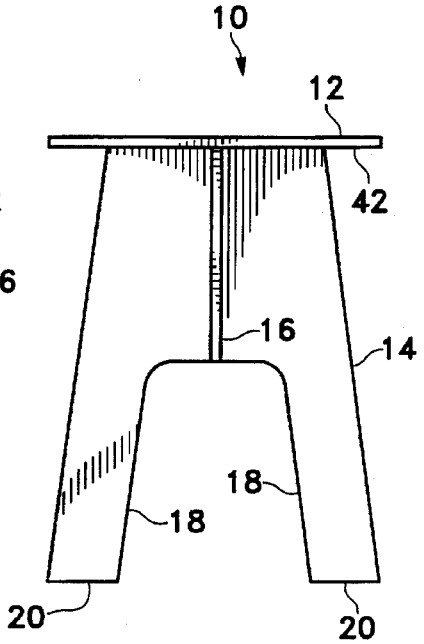
FIG. 2 is a left-hand or right-hand side elevation of the portable table of FIG. 1.
Figure 3:
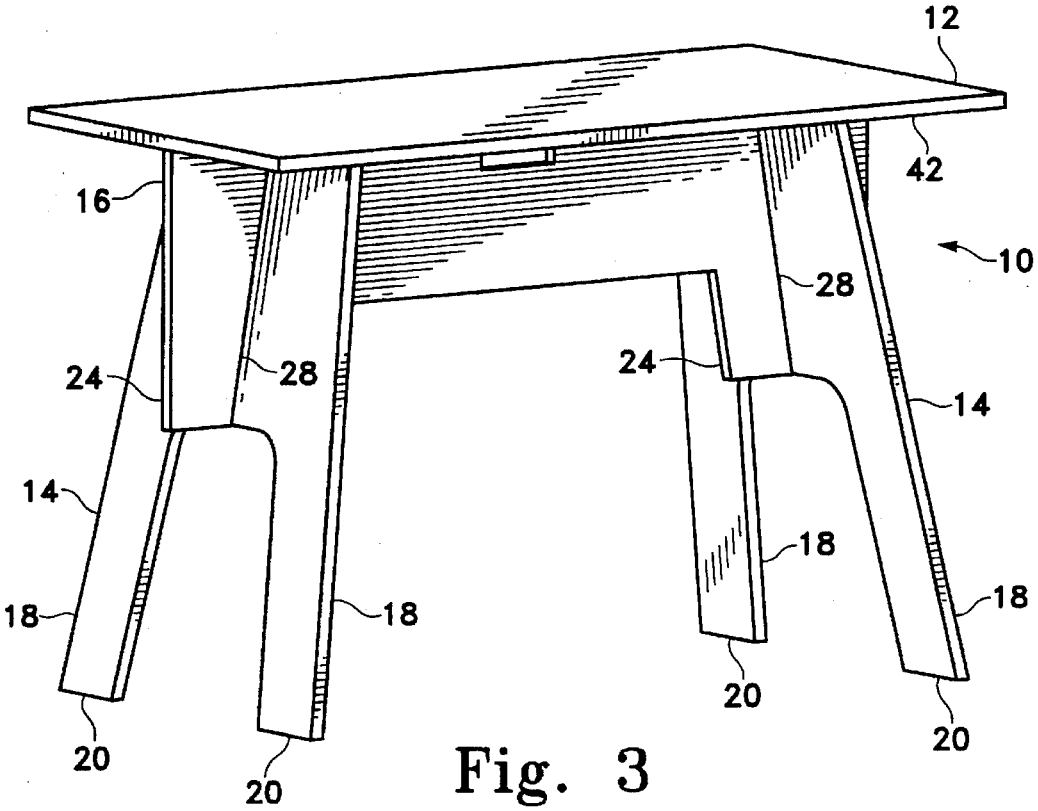
FIG. 3 is a front left-hand perspective view of the portable table of FIG. 1.
Figure 4:
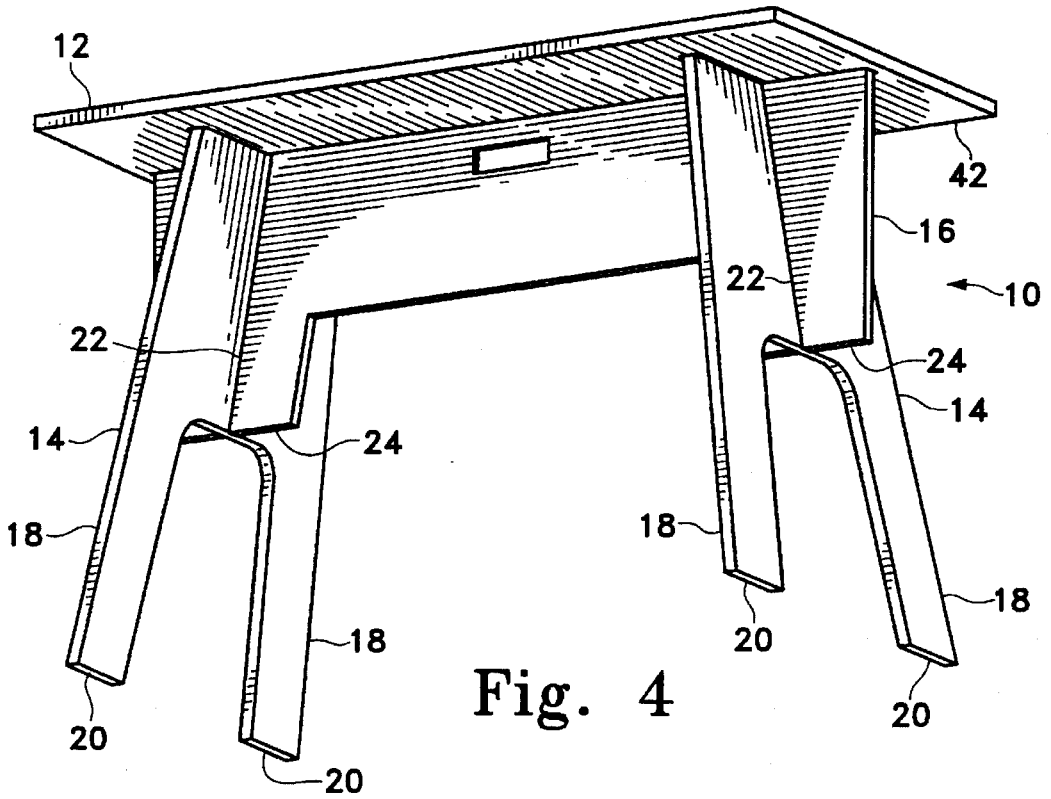
FIG. 4 is a front left-hand perspective view of the portable table of FIG. 1 illustrating the lower surface of the top and the central brace member.

Referring to FIG. 1, there is shown a portable table 10 according to the present invention, that can be easily assembled and disassembled and which requires no fasteners. When disassembled, the portable table 10 consists of four flat planar pieces: a table top 12, two identical pedestals 14, and a central brace member 16. When the portable table 10 is assembled, the pedestals 14 are spaced apart and lie at an angle of from about 65–85 degrees from the horizontal with 80 degrees from the horizontal being the preferred angle, with the tops of the pedestals 14 being closer together than the bottoms, thereby presenting a trapezoidal silhouette when viewed from the front or the back, with the short side of the trapezoidal shape at the top. Each pedestal 14 includes a pair of legs 18 that are formed by providing a U-shaped cut-out portion each pedestal 14, with a wider cut-out portion lying along a bottom edge of said pedestal, which, if work began with a solid sheet of material, such as plywood, would be removed to form the legs 18. Each leg 18 includes a foot 20 consisting of a straight bottom edge of the pedestal material, but which may also include a rubber tip, crutch-type tip, attached member of greater surface area for supporting loads on soft surfaces, or other foot attachments. All four of the feet 20 lie in a single plane when the portable table 10 is assembled, allowing the portable table 10 to present a rigid non-rocking table when placed on a flat surface. Each pedestal 14 includes a longitudinal center line that lies along a line in the middle of the U-Shaped opening between the two legs 18 on one pedestal 14 and a pedestal slot 22 is formed into each pedestal 14 from a top edge 38 of each pedestal to a point lying in a range of one-fourth to one-half the height of the pedestal 14.

The central brace member 16 is substantially rectangular in elevation, with a central trapezoidal portion having a larger base portion lying along a lower edge 24 of the central brace member 16. This design reduces the weight of the central brace member 16 without significantly reducing its compression strength. The central brace member further includes a rectangular handle opening 26, which provides a convenient means for grasping the central brace member 16 with a good balance during assembly and disassembly.

Figure 5:
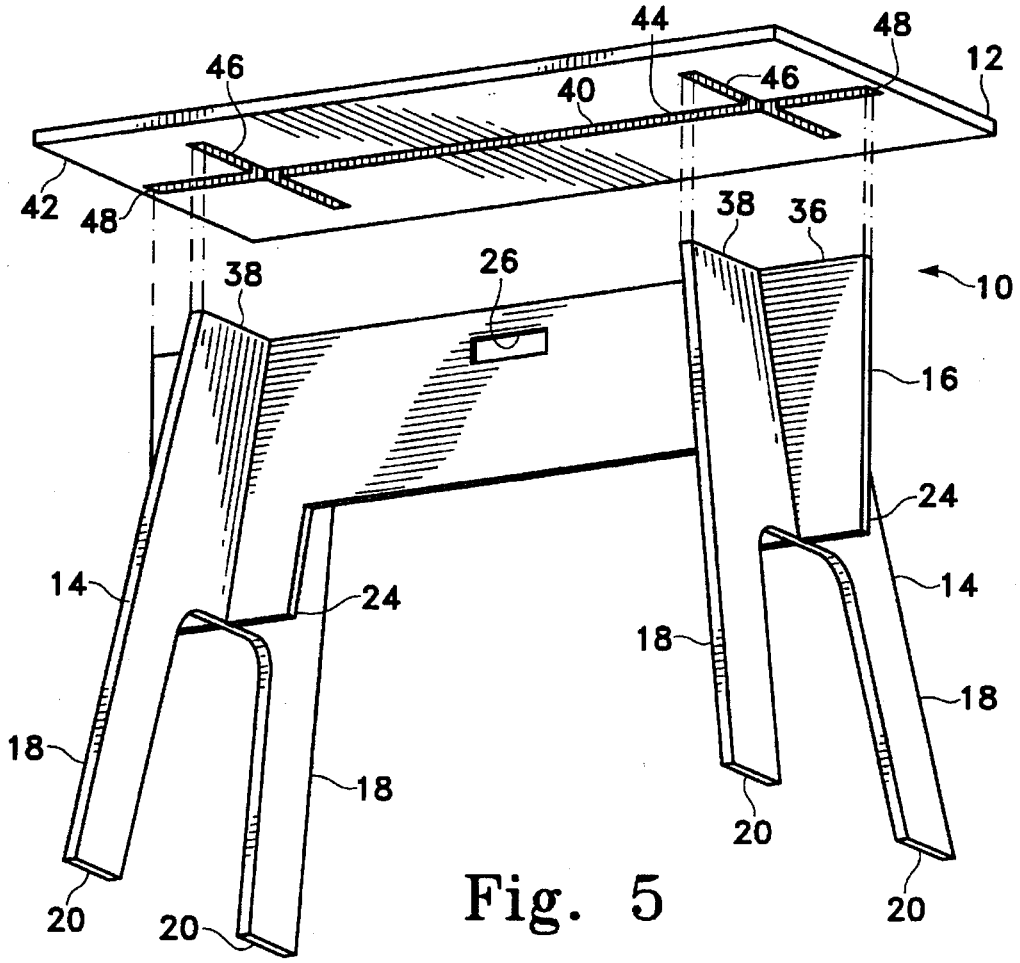
FIG. 5 is a front left-hand perspective view of the portable table of FIG. 1 illustrating the lower surface of the top and the central brace member according to FIG. 4 illustrating the means for connecting the top to the supporting structure.
Figure 6:
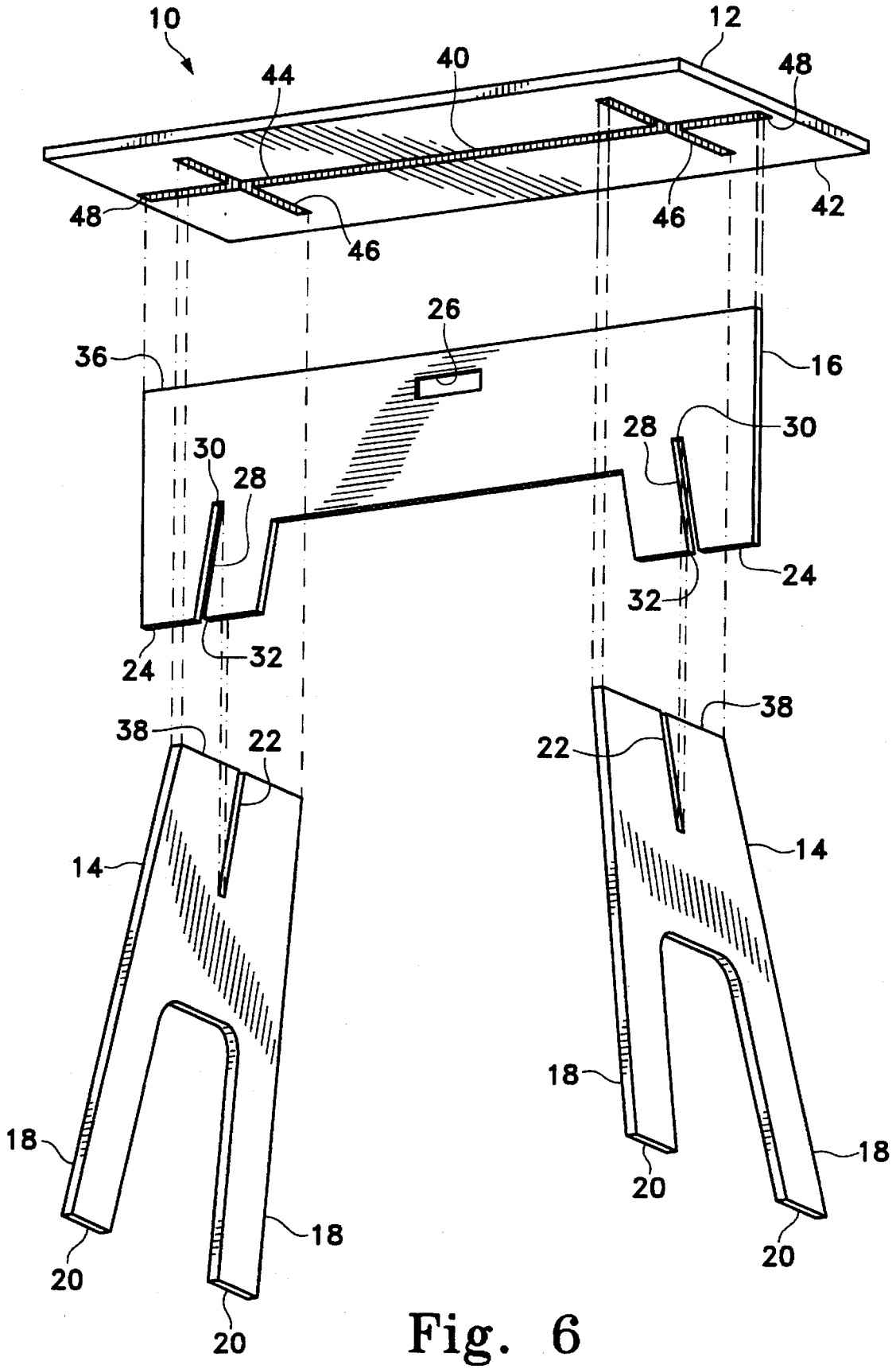
FIG. 6 is an exploded front left-hand perspective view of the portable table of FIG. 1 illustrating the assembly and disassembly of the portable table according to the present invention.

As best seen in FIG. 6, the central brace member further includes a pair of brace member slots 28, with the slots 28 lying closer together at a top end 30 of each slot than at a bottom end 32 of each slot, with the resulting angle from the horizontal lying in a range of about 70–85 degrees, with the preferred angle being about 80 degrees. The brace member slots 28 extend from the lower edge 24 of the central brace member 16 to a top end 30 that lies within a range of about ⅓–⅔ of the distance between the bottom edge 24 and a top edge 36 of the central brace member 16, with the preferred distance being about ½ of this distance. The lengths of the pedestal slots 22 and the brace member slots are the same. One pedestal 14 is aligned with the central brace member such that the pedestal slot 22 aligns with one brace member slot 28 and the two pieces are pushed together along the slots 22, 28. Then the other pedestal 14 is similarly engaged on the remaining brace member slot. The dimensions of the pedestals 14 and the central brace member 16 are such that top edge 36 of the central brace member 16 and the top edges 38 all lie in a single plane. This state of assembly is shown in FIG. 5. The top edges of these pieces forms a straight line intersected by a pair of shorter perpendicular lines adjacent to each end of the straight line. In the preferred embodiment described in FIGS. 1–6, the entire pattern thus described is seated into aligned channels in the lower surface of the table top 12, as described below. This edge pattern is used to provide extra stability to the portable table 10 as described below. The edge pattern extends nearly the length and breadth of the table top 12, allowing asymmetric placement of a load or loads on the table top 12.

As best seen in FIGS. 5, 6, a channel 40 is formed into a bottom surface 42 of the table top 12. The channel 40 is formed such that it is the same width as the top edges 36, 38 and define the same pattern as the top edges 36, 38. In the preferred embodiment described herein, the channel 40 includes a central longitudinal portion 44 lying along a straight line on a long dimension of the table top 12 and approximately in the middle of the width of the table top 12. A pair of parallel short channel members 46 intersect and are perpendicular to the central longitudinal portion 44 of the channel 40 and all three members 44, 46 of the channel 40 lie in the same plane. Each of the short channel members 46 lie about ¼–⅓ toward the middle of the central longitudinal portion 44, as measured from the closest end 48 of the central longitudinal portion 44 of the channel 40. The intersecting channel members 44, 46, and 46 form an H-shaped channel or slot that effectively increases lateral stability of the table 10. The table top 12 is seated upon the top edges 36, 38 such that the top edges 36, 38 and the mating channel 40 in the bottom surface 42 of the table top 12 are aligned. A firm tapping with a rubber hammer or the bare hand of the worker will firmly seat the top edges 36, 38 in the channel 40 and the portable table 10 is then fully assembled, as shown in FIGS. 1–4. Alternatively, the portable table 10 may be readily assembled by holding the central brace member 16 in a vertical position with the top edge 36 on the ground and then attaching the pedestals 14, so that the resulting structure is upside down. It can then be inverted to permit installation of the top table top 12. In another alternative assembly process, the table top 12 may be placed first on the ground upside down and the other three pieces attached as described in the preceding sentence. Either of these two alternative assembly processes reduces the lifting required for assembly, requiring the worker to lift only one piece of the portable table 10 at a time. The assembly in either case may simply be rotated into the desired working position, that is, with the table top 12 supported above the ground.

To disassemble the portable table 10, the top 12 is removed and set aside. Then each of the pedestals 14 is pulled off the central brace member 16, either separately or at the same time.

It has been found that ¾ inch (1.9 cm) plywood is a good material from which to make the portable table 10 and that a table top 12 approximately 5'×6' (152–185 cm) made from this material and supported by proportionately sized pedestals 14 and a central brace member 16 of the same material will easily support a compressive load of 500–600 lbs. (225–275 kg.), with great lateral strength against wiggling from side to side. The portable table 10 may also be conveniently made of plastic, whether injection molded or the like, or worked like wood. It has also been found that the channel 40 and edges 36, 38 will withstand many repeated cycles of assembly and disassembly while maintaining a firm union of the channels, slots and so forth that strengthen the portable table 10.

Figure 8:
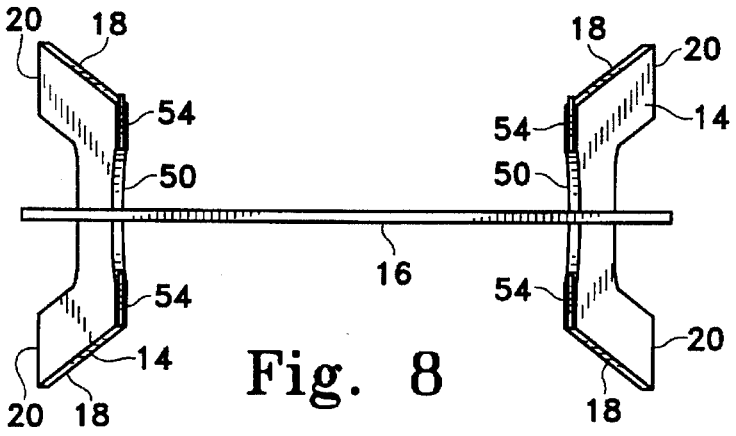
FIG. 8 is a top plan view of a partially assembled portable table of the alternative embodiment of the portable table.
Figure 7:
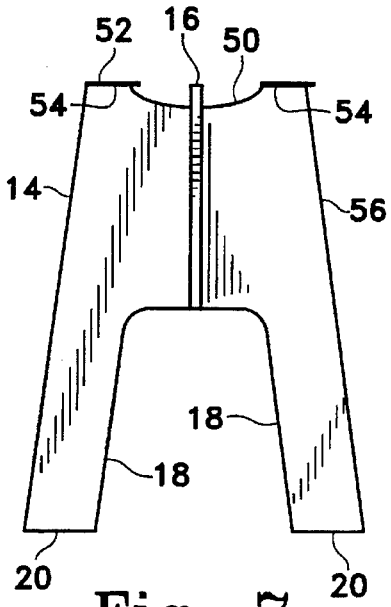
FIG. 7 is a side elevation of a pedestal of an alternative embodiment of the portable table of FIG. 1.

Referring now to FIGS. 7–10 there is shown an alternative embodiment of the portable table 10 which provides a passive locking system that permits the fully assembled portable table 10 to be picked up and carried by the top when it is fully assembled without risk of having the top come off. As shown in FIGS. 7 and 8, an intermediate sculpted out or cupped out portion 50 is formed in the top edge 38 of each pedestal 14. A metal tongue 52 is fixed in each of the four resulting flat upper pads 54 such that, as seen in FIG. 7, two left-hand metal tongues 52 project a short distance over the cupped out portion 50 and two right-hand tongues 52 project outwardly a short distance from the outer edge 56 of each pedestal 14.

Figure 9:
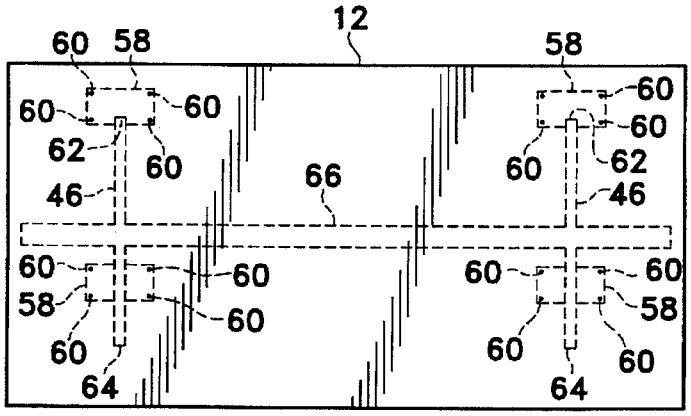
FIG. 9 is a top plan view of an alternative embodiment of the top of the portable table illustrating an alternative fastening system.
Figure 10:
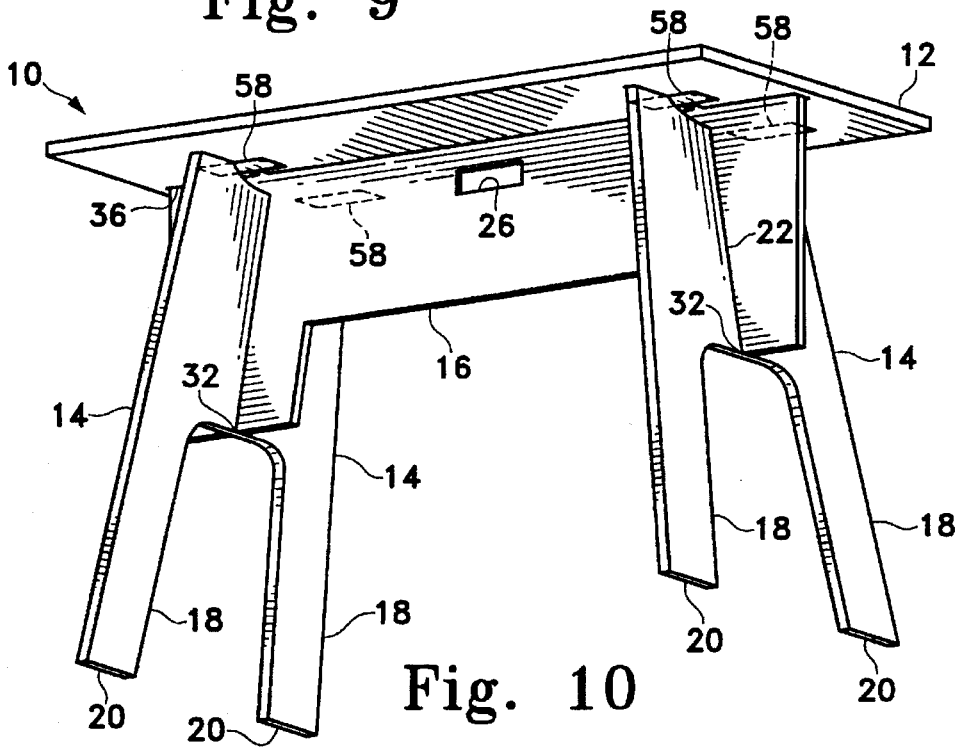
FIG. 10 is a lower left-hand front perspective view of the alternative embodiment of the portable table shown fully assembled.

As shown in FIG. 9, this alternative embodiment includes four locking plate 58 fastened to the bottom surface 42 of the table top 12 by screws 60. Two of the locking plates 58, which are sheet metal, bridge an end 62 of each short channel member 46. The two remaining locking plates 58 each bridge one of the short channel members 46 at a location intermediate of the front edges 64 of the short channel members 46 and a wide longitudinal channel 66 that intersects the short channel members 46 at right angles. The pedestals 14 and the central brace member 16 are assembled as described above and as shown in FIG. 8. Then the table top is lifted above the pedestals 14 and tilted at an angle slightly above the horizontal and is slid down and back so that the locking plates 58 are engaged by the metal tongues 52, so that the table 12 lies flat on the pedestals 14 and is locked into place, as shown in FIG. 10.

The wide longitudinal channel 66 is wide enough to permit the table top 12 to sweep over the top edge 36 of the central brace member 16 during installation of the table top 16 and is therefore necessarily wider than the central channel 40 in the table top 12 (e.g., FIG. 6). The wide longitudinal channel 66 can be offset from the longitudinal centerline of the table top 12 to provide a sufficient depth from a front edge of the table top 12 to the central brace member 16 to allow a person to sit in a chair comfortably at the portable table 10 and so use it as a desk.

Figure 11:
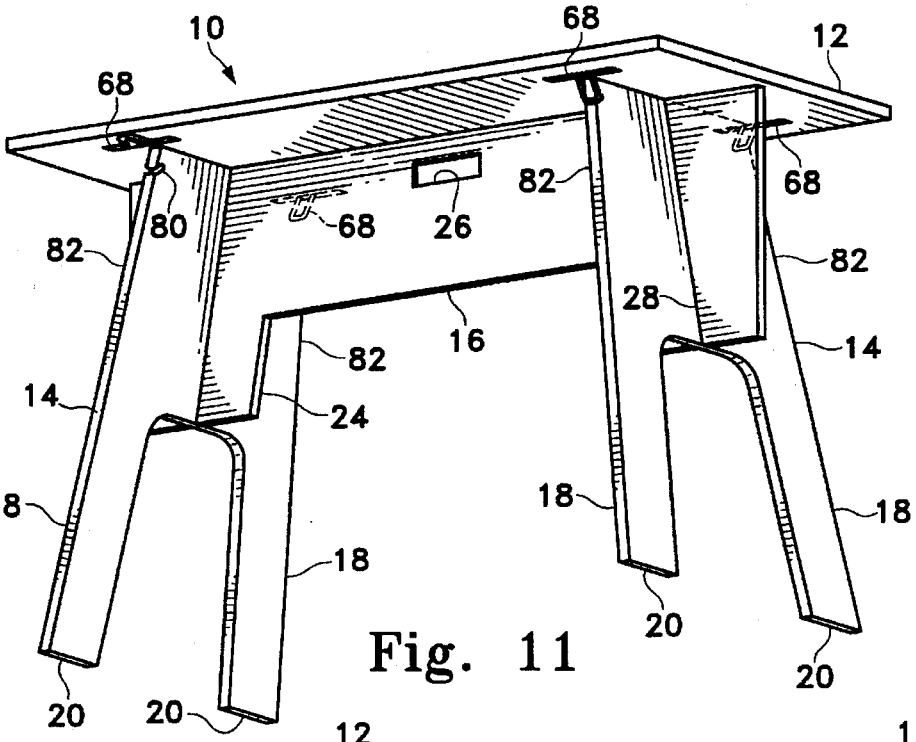
FIG. 11 is a lower left-hand front perspective view of the portable table of FIG. 1 illustrating an optional fastening system utilizing a recessed locking clip.
Figure 12:
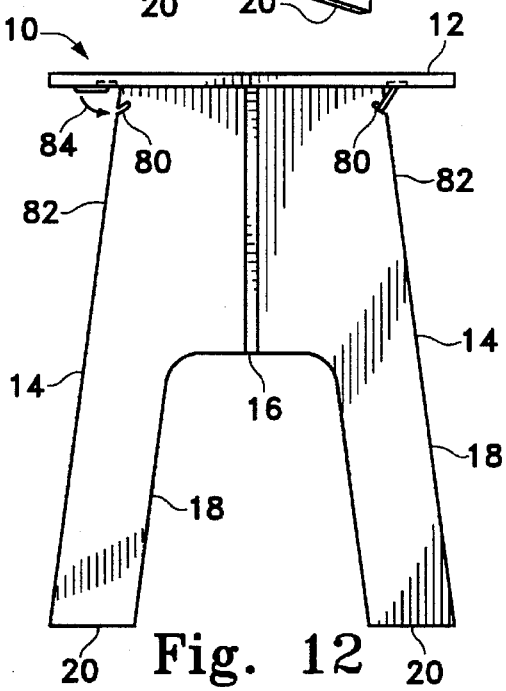
FIG. 12 is an end elevation of portable table showing the fastener system of FIG. 11.
Figure 14A:
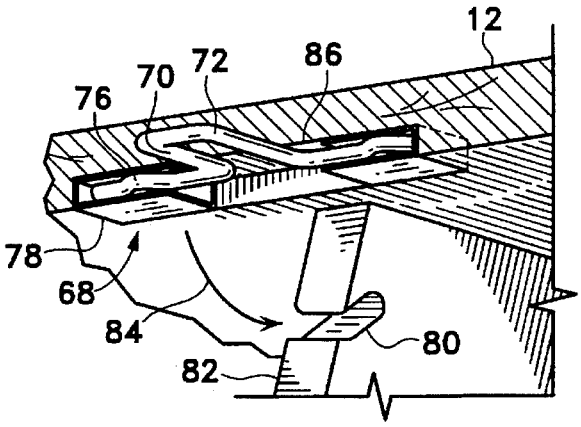
FIG. 14*a* is an enlarged perspective view illustrating the operation of the fastening system with the locking clip in the unlocked position.
Figure 13:
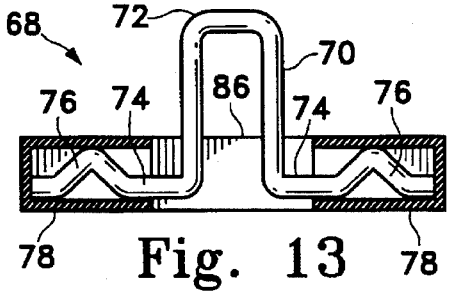
FIG. 13 is a side elevation, partially in section, showing the fastener of FIG. 11.
Figure 14B:
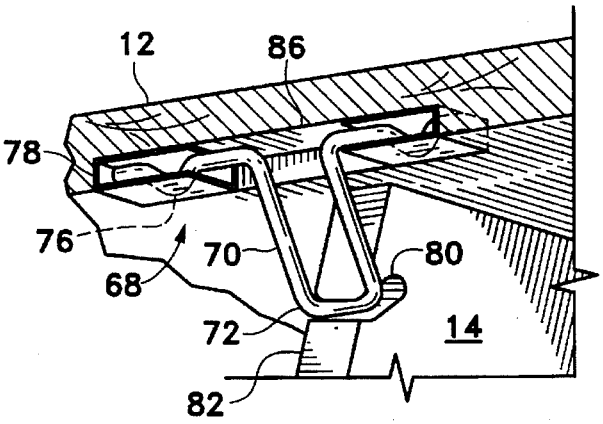
FIG. 14*b* is an enlarged perspective view illustrating the operation of the fastening system with the locking clip in the locked position.

Referring now to FIGS. **11–14*b*, there is shown an optional fastening system having a plurality of recessed locking clips that toggle between an open position against the underside of the table top 12 and a locked position in an aligned slot, which permits the portable table 10 to be picked up by the top 12 without becoming disassembled. In particular, as shown in FIG. 13 a bent wire clip 70 includes a centrally located outwardly projecting U-shaped locking portion 72, a pair of offset straight connecting portions 74 and terminates in a V-shaped portions 76 retained in a durable rectangular end housings 78. The V-shaped portions are seated in the end housings 78 in such a fashion that the U-shaped locking portion 72 toggles between a locking position in which the U-shaped locking portion 72 engages an upwardly angled slot 80 in an outer edge 82 of each pedestal 14 (FIG. 14*b*) and unlocked position in which it lies adjacent to and parallel to the bottom surface 42 of the table top 12 (FIG. 14*a*). The U-shaped locking portion 72 is in stable equilibrium only in one of these two positions and snaps into either one or the other whenever it is located in an intermediate position. As shown in FIGS. 11, 12, the left-hand side locking clip mechanism 68 is in the unlocked position and by toggling the bent wire clip 70 in the direction of the arrow 84 (FIGS. 12 and 14*a*), the bent wire clip 70 snaps into its locking position in the slot 80 as shown in the right-hand side of FIGS. 11 and 12 and in FIG. 14*b*. Each locking clip mechanism 68 is matingly seated and fixed into a recess 86 in the bottom surface 42 of the table top 12. There are four locking clip mechanism 68 and aligned slots 80, with one such unit located at the juncture of the table top 12 and each outer edge 82 of each pedestal 14**, as shown.

Naturally, other materials and dimensions can be easily designed for different applications. For example, the top can be square, octagonal, or other shapes. The portable table 10 can be made from plastic, wood, metal, fiberglass, and other similar materials as meets specific application needs. The portable table 10 can also be used as a bracing system for retaining horizontal, as well as vertical, loads by turning the portable table 10 on its side and wedging it between a structure to be supported and an adjacent supporting structure. That is, for example, the portable table 10 can be used to support the lateral load exerted on a concrete form by bracing the form against the excavated earthen walls lying adjacent to the concrete form.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

We claim:

1. A portable table comprising:

a. a pair of spaced pedestals each having a bottom edge resting on a supporting surface, wherein each said pedestal further comprises a pedestal slot formed from a top edge of each said pedestal to a point about one-half of the distance from said top edge of said pedestal to an upper end of a U-shaped cut out portion of each said pedestal;

b. a central brace member between said pedestals and means for connecting said pedestals to said central brace member, wherein said central brace member further comprises a trapezoidal cut-out portion having its long dimension along a bottom edge of said central brace member and said central brace member further comprises a pair of slots running from a bottom edge of said central brace member to a point about one-half of the distance between said bottom edge and a top edge of said central brace member, with said pedestal slots engaging and mating with said brace member slots, whereby said top edges of said pedestals and of said central brace member lying in a single plane;

c. a top seated on said top edges of said pedestals and said top edge of said central brace member, with said top edge of said central brace member contacting said top along a line along a longitudinal center of said top; and d. means for retaining said top on said top edges of said pedestals and said top edge of said central brace member; and e. means for fastening said top to said pedestals, wherein said fastening means further comprises a plurality of locking clip mechanisms, each said locking clip mechanism comprising a bent wire, each said bent wire having a protruding U-shaped centrally located portion and a straight connecting portion extending from each of two legs at the ends of the U-shaped portion, each straight connecting portion having a V-shaped notch therein, with said straight connecting portions seated in a recess in a bottom surface of said top adapted to toggle into an aligned slot in an edge of said pedestal.

* * * * *